United States Patent [19]

De Teso

[11] Patent Number: 4,918,459

[45] Date of Patent: Apr. 17, 1990

[54] APPARATUS FOR PROTECTING ANTENNAS

[76] Inventor: John S. De Teso, 1902 First St., La Marque, Tex. 77568

[21] Appl. No.: 315,484

[22] Filed: Feb. 27, 1989

[51] Int. Cl.[4] ..... H01Q 1/42

[52] U.S. Cl. ..... 343/872; 343/840

[58] Field of Search ..... 343/872, 781 C, 781 PA, 343/781 R, 840

[56] References Cited

U.S. PATENT DOCUMENTS 3,351,947 11/1967 Hart ..... 343/872

4,126,864 11/1978 Hopkins ..... 343/872

4,282,530 8/1981 Semplak ..... 343/872

*Primary Examiner*—Rolf Hille

*Assistant Examiner*—Doris J. Johnson

*Attorney, Agent, or Firm*—Matthews & Assoc.

[57] ABSTRACT

Shield apparatus for protecting the covering across the face of a parabolic antenna may include an elongated shield which curves from one end to another and attachment elements by which the shield may be affixed to the antenna to overlie the uppermost periphery of the covering in a spaced relationship therewith.

12 Claims, 2 Drawing Sheets

APPARATUS FOR PROTECTING ANTENNAS

BACKGROUND OF THE INVENTION

1. Field of the Invention

The present invention pertains to apparatus for protecting antennas. More specifically, the present invention pertains to apparatus for protecting antennas of the type which include a parabolic reflector.

2. Description of the Prior Art

One type of antenna utilized in the communications industry is the parabolic antenna which includes a parabolic reflector having a central axis and a concave face. Electronic signals are received by such antennas for further use. In microwave transmission, there antennas are typically attached to a tower structure for long line microwave communication.

A typical microwave antenna includes a parabolic relfector around the periphery of which is attached some sort of covering for protecting the antenna from physical damage and damage from the environment. The covering may be attached to a cylindrical housing or shroud which is attached around the periphery of the reflector. The shroud is usually of a relativley hard material and usually provides some means by which the cover, which is of a relatively soft or fabric like material may be attached to the antenna. The cover protects the face of the parabolic reflector from physical damage and from the elements, but does not prevent the receiving of microwaves thereby. These covers are sometimes referred to as flexible planar radomes or by various trade names such as Teglars, Hypalons, etc.

Since such antennas are typically attached to towers which extend high into the air, they provide natural perches for buzzards, sea gulls and other birds. Such large birds frequently perch or rest on the top of an antenna where they constantly peck and claw the soft covering until the covering is torn and damaged so as to require replacement. Since such antennas are high in the air, the replacement of the coverings therefor is relatively hazardous and expensive. Thus, anything which would prolong the lift of these coverings would be welcomed in the industry.

SUMMARY OF THE PRESENT INVENTION

In the present invention, apparatus is provided for protecting the portion of parabolic antennas which are most vulnerable to damage from birds by providing shield apparatus for attachment thereto. The apparatus may include an elongated shield which curves from one end to another and attachment elements by which the shield is affixed to the antenna so that when the axis of the antenna is inclined relative to the surface of the earth, the shield overlies the uppermost periphery of the protective cover in a spaced relationship therewith. The elongated shield provides a cylindrical surface which overlaps the protective cover in spaced relationship therewith to prevent birds from perching or resting thereon.

The shield material is relatively hard and not susceptible to damage from the claws and/or beaks of birds, even if they rest or perch thereon. However, the shield apparatus is relatively inexpensive and easy to install, especially if installed at the initial installation of the antenna. Not only does the shield apparatus protect against damage from birds, it may also provide additional protection from damage by the sun and other elements. In fact, many other objects, features and advantages of the invention will be apparent from reading the description which follows in conjunction with the accompanying drawings.

DESCRIPTION OF PREFERRED EMBODIMENT

Figure 1:
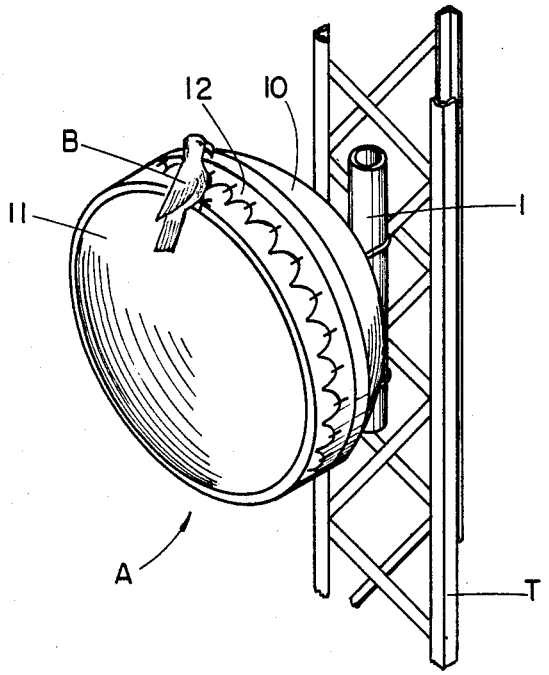
FIG. 1 is a pictorial representation of a microwave antenna attached to a tower and showing a bird resting thereon.
Figure 2:
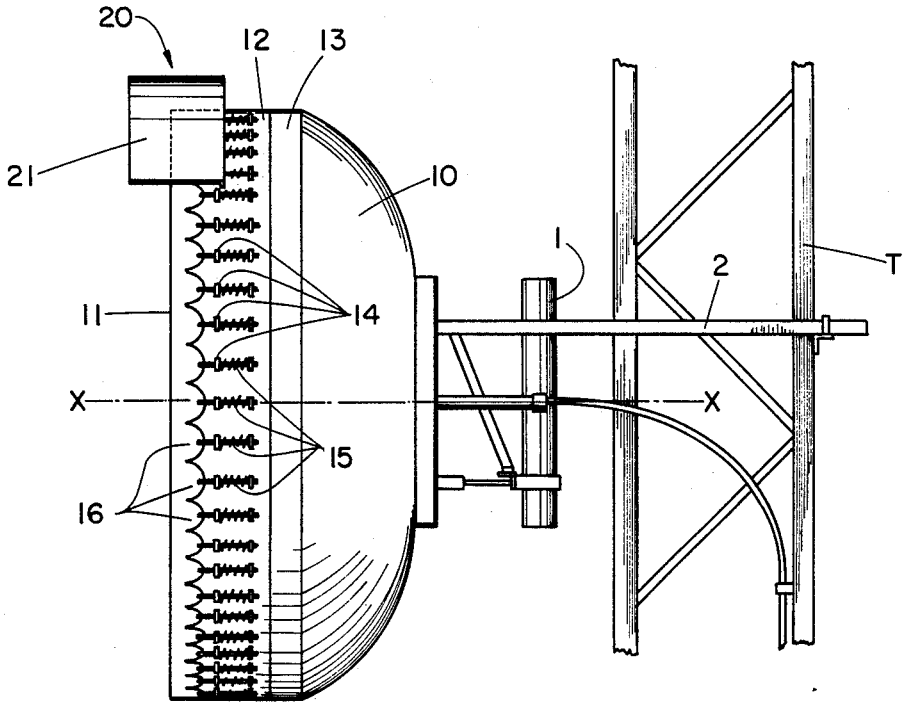
FIG. 2 is a side elevation view of a parabolic microwave antenna showing the protective apparatus of the present invention, according to a preferred embodiment thereof, attached thereto.

Referring now to FIGS. 1 and 2, there is shown a parabolic antenna A for receiving communication signals. The antenna A may be attached to a tubular member 1 which is in turn attached by structural elements 2, etc. to a tower T which extends up into the air.

The parabolic antenna A is of the type which includes a parabolic reflector 10 having a concave face (not shown) and a central axis X—X. Attached around the periphery of the reflector 10 over the face thereof is a protective covering 11 which covers the reflective face and protects it from physical damage and damage from the environment. Typically, the covering 11 is attached to a cylindrical housing or shroud 12 which is in turn fastened by some type of circular connector 13 to the periphery of the reflector 10. In fact, the shroud 12 maybe considered part of the reflector 10 and usually aids in directing signals thereto.

The shroud 12 is of a relatively rigid material such as aluminum or other metal and may be provided around its circumference with a number of brackets 14 for supporting a series of J bolts or the like. These J bolts 15 may engage reinforced elements 16 around the edges of the covering 11 to stretch the covering 11 over the opening of the shroud 12 much as the head of a drum. As mentioned, the cover 11 therefore provides protection against physical damage or environmental damage to the face of the antenna reflector 10 without interferring with the transmission of signals thereto. Coverings such as covering 11 are sometimes referred to flexible planar radomes or by the trade names Teglars, Hypalons, etc.

Referring especially to FIG. 1, large birds B such as buzzards, seagulls and the like frequently perch on the uper periphery of the antenna A. These birds claw and peck at the generally soft material of the covering 11, frequently damaging them to the point where they must be replaced. As can be understood, it is hazardous and expensive to replace such a covering. To prevent this from happening, the protective shield or apparatus 20 shown in FIG. 2 may be installed.

Figure 3:
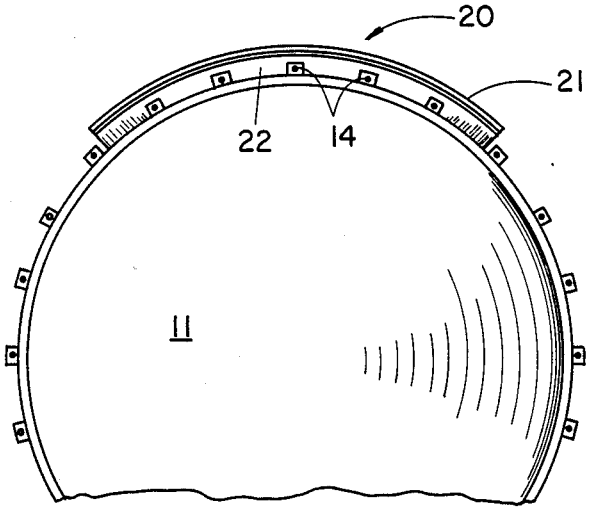
FIG. 3 is a partial front view of the parabolic antenna shown in FIG. 2 also showing the protective apparatus of the present invention according to a preferred embodiment thereof.
Figure 4:
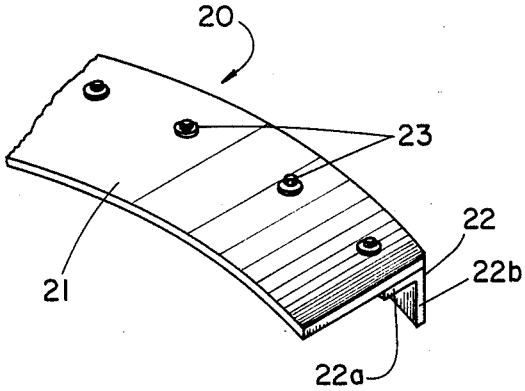
FIG. 4 is a perspective view of an end portion of the protective apparatus of the present invention shown in FIGS. 2 and 3, according to a preferred embodiment thereof.
Figure 5:
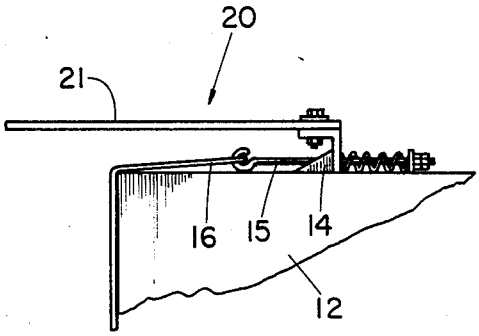
FIG. 5 is a detailed cross section of the protective apparatus of FIGS. 2, 3 and 4, according to a preferred embodiment thereof.

Referring, in addition, to FIGS. 3, 4 and 5, the protective apparatus 20 will be described in greater detail. The protective apparatus 20 comprises an elongated shield member 21 which curves in a arc from one end to the other to provide a cylinder surface. The arc thereof is substantially concentric with the reflector 10 but of a radius which is somewhat greater than the radius of the reflector 10 and its face.

The apparatus 20 also includes an attachment member 22 which in the exemplary embodiment is "L" shaped in cross section, one leg of the L 22*a* forming a cylindrical support portion to which the elongated shield 21 is attached and the other leg 22*b* forming a support portion by which the shield apparatus 20 may be attached to the antenna A. As illustrated, corresponding holes are provided in the elongated shield 21 and the support portion 22*a* of the attachment means 22 through which fasteners 23 may be inserted. Holes may also be provided through the support portion 22*b*. In the exemplary embodiment, some of the J bolts 15 may be placed in these holes, such as shown in FIG. 5, so that the shield apparatus 20 may be properly held in place thereby, requiring no additional fasteners.

As can be seen, especially in FIGS. 2, 3 and 5, when the protective apparatus 20 is properly installed, the elongated shield 21 overlies the uppermost periphery of the protective cover 11 in a spaced relationship therewith. This prevents birds from pecking or clawing the cover 11, preventing damage thereto.

Figure 6:
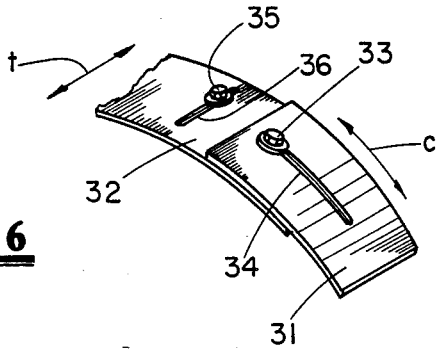
FIG. 6 is an alternate shield embodiment where the shield of FIGS. 2–5 is made up of two or more shield members.

An alternate shield embodiment is shown in FIG. 6 in which the longated shield 21 of FIGS. 2–5 is replaced by a shield made up of two or more shield segments, e.g. 31 and 32. In this embodiment the segment 32 has an arcuate slot 34. Upon loosening of the fastener 33 the segment may be moved in the direction of arrows "c" to increase or decrease the arcuate length of the shield. As also shown in FIG. 6, at least one of the segments 32 may be transversely slotted at 36. This allows the shield, upon loosening of fastner 35, to be transversely adjusted in the directions of arrows "t". Many variations in length, width and location of the shield may be effected with slotted connections and multiple part shields.

The shield apparatus can be made of a number of materials. The shield members 21, 31, 32 are preferably of a very hard material such as Lexan plastic. The support member 22 can be made of aluminum or other materials. If desired, the shield members 21, 31, 32 could also be made of a material which would prevent or reduce transmission of ultraviolet light. As such, it might reduce damage to the cover 11 from ultraviolet light. If desired, the elongated shield 21, 31, 32 could be made of a mesh-like material to reduce wind loads. Thus, it is clear that the elongated shields 21, 31, 32 could be made of many types of materials and in many different configurations which would provide protection from birds as well as other damaging influences or elements. While a single embodiment of the invention has been described herein, many variations thereof can be made without departing from the spirit of the invention. Accordingly, it is intended that the scope of the invention be limited only by the claims which follow.

I claim:

1. Apparatus for protecting the shroud and radome portions of a parabolic antenna which includes a parabolic reflector having a central axis and a concave face around the periphery of which is attached said shroud and radome, a protective cover covering said reflector face for protection from physical damage and damage from the environment, said apparatus comprising:

an elongated shield which curves from one end to another providing a cylindrical surface; and, attachment means affixed to said shield and by which said shield apparatus may be attached to said antenna so that when the axis of said antenna is inclined relative to the surface of the earth said shield overlies the uppermost periphery of said protective cover in spaced relationship therewith in close proximity to prevent birds from perching thereon.

2. Shield apparatus as set forth in claim 1 in which said attachment means comprises a curved support member which is "L" shaped in cross-section forming a cylindrical support portion to which said shield is attached and an attachment portion perpendicular to said support portion by which said shield apparatus is attached to said parabolic antenna.

3. Shield apparatus as set forth in claim 2 in which said support portion of said attachment means is provided with holes the axes of which are substantially paralled with the central axis of said reflector and through which fasteners may be inserted for connecting said attachment means around the periphery of said reflector.

4. Shield apparatus as set forth in claim 1 in which said elongated shield is made of a relatively hard material which is not easily gripped by the feet of a bird.

5. Shield apparatus as set forth in claim 1 in which said elongated shield is made of a material which substantially reduces the passage of ultraviolet light therethrough.

6. Shield apparatus as set forth in claim 1 in which said elongated shield is provided with transverse slots allowing transverse positioning of said elongated shield.

7. Shield apparatus as set forth in claim 1 in which said radome is attached by first attachment means to said parabolic reflector and wherein said apparatus for protecting said shroud and radome is attached to said parabolic antenna by a second attachment means in combination with said first attachment means.

8. The apparatus of claim 7 where said first attachment means comprises J bolts and are wherein said second attachment means comprises holes provided in said apparatus spaced so as to correspond to the J bolt locations of said first attachment means.

9. Shield apparatus as forth in claim 7 in which said cylindrical surface of said elongated shield curves in an arc which is substantially concentric with the periphery of said reflector face but having a radius which is greater than the radius of said reflector face.

10. Shield apparatus as set forth in claim 9 in which said cylindrical surface extends outwardly from said reflector so that said protective cover at the periphery of said reflector lies beneath a mid-portion of said cylindrical surface.

11. Shield apparatus as set forth in claim 9 in which the length of said arc from one end of said cylindrical surface to the other is less than one-half of the circumference of said reflector face. pg,15

12. Shield apparatus as set forth in claim 9 in which said elongated shield comprises two or more segments attached so as to permit increasing or decreasing of the length of said arc.

* * * * *